US007231774B2

(12) United States Patent
Taras et al.

(10) Patent No.: US 7,231,774 B2
(45) **Date of Patent: *Jun. 19, 2007**

(54) MULTI-CIRCUIT REFRIGERANT CYCLE WITH DEHUMIDIFICATION IMPROVEMENTS

(75) Inventors: Michael F. Taras, Fayetteville, NY (US); Alexander Lifson, Manlius, NY (US)

(73) Assignee: Carrier Corporation, Syracuse, NY (US)

( * ) Notice: Subject to any disclaimer, the term of this patent is extended or adjusted under 35 U.S.C. 154(b) by 388 days.

This patent is subject to a terminal disclaimer.

(21) Appl. No.: 10/833,368

(22) Filed: Apr. 28, 2004

(65) Prior Publication Data

US 2005/0241334 A1 Nov. 3, 2005

(51) Int. Cl.
*F25B 49/00* (2006.01)
*F25D 17/06* (2006.01)
*F24F 11/00* (2006.01)

(52) U.S. Cl. ..... 62/176.5; 62/90; 62/513; 236/44 C

(58) Field of Classification Search ..... 236/44 C; 62/513, 324.1, 324.5, 90, 93, 176.5, 173, 62/196.4
See application file for complete search history.

(56) References Cited

U.S. PATENT DOCUMENTS

| | | | | |
|---|---|---|---|---|
| 6,644,049 | B2 * | 11/2003 | Alford | 62/173 |
| 2003/0192331 | A1 | 10/2003 | Alford | |
| 2006/0053822 | A1 * | 3/2006 | Taras et al. | 62/324.1 |

* cited by examiner

*Primary Examiner*—Chen Wen Jiang
(74) *Attorney, Agent, or Firm*—Carlson, Gaskey & Olds, PC

(57) ABSTRACT

Multi-circuit refrigerant systems are provided with better control over a dehumidification function. In one embodiment, system circuits have means of communication with each other through connecting lines and flow control devices operable on demand. In another embodiment, a single reheat heat exchanger is utilized for both circuits, ensuring heat transfer interaction between the circuits. In yet another embodiment, a control unit operates refrigerant circuits in such a way that if some circuits are in a reheat mode, the remaining circuits are either shut off or are in an enhanced reheat mode.

11 Claims, 2 Drawing Sheets

MULTI-CIRCUIT REFRIGERANT CYCLE WITH DEHUMIDIFICATION IMPROVEMENTS

BACKGROUND OF THE INVENTION

This application relates to multi-circuit refrigerant systems that are capable of executing multiple modes of operation. Typically, these systems have a reheat coil(s) incorporated into the system design to provide a reheat function, and additional control means capable of alternating between operational regimes independently for each circuit in response to environmental conditions and load demands.

Refrigerant cycles are utilized to control the temperature and humidity of air in various environments to be conditioned. Typically, a refrigerant is compressed in a compressor and delivered to a condenser. In the condenser, heat is exchanged between outside ambient air and the refrigerant. From the condenser, the refrigerant passes to an expansion device in which the refrigerant is expanded to a lower pressure and temperature, and then to an evaporator. In the evaporator, heat is exchanged between the refrigerant and the indoor air, to condition the indoor air. When the refrigerant cycle is in operation, an evaporator cools, the air that is being supplied to the indoor environment. In addition, as the temperature of the indoor air is lowered, moisture usually is also taken out of the air. In this manner, the humidity level of the indoor air can also be controlled.

In some cases, the temperature level, to which the air is brought to provide comfort environment in the conditioned space, may need to be higher than the temperature that would provide the ideal humidity level. Such corresponding levels of temperature and humidity may vary from one application to another and are highly dependent on environmental and operating conditions. This has presented design challenges to refrigerant cycle designers. One way to address such challenges is to utilize reheat coils. In many cases, the reheat coils placed in the path of the indoor air stream, behind the evaporator, are employed for the purpose of reheating the air supplied to the conditioned space after it has been overcooled in the evaporator for moisture removal.

Multi-circuit refrigerant systems are also applied in the industry, wherein separate compressors and heat exchangers operate under a single control to provide various levels of sensible and latent capacity in response to the load demands and wherein each circuit can independently function in one of several operational regimes.

A further option available to a refrigerant system designer is to integrate a reheat coil(s) in the schematics for some of the refrigerant circuits of a multi-circuit system. As known, in a reheat coil, at least a portion of the refrigerant upstream of the expansion device is passed through a reheat heat exchanger and then is returned back to the main circuit, and at least a portion of the conditioned air having passed over the evaporator is then passed over this reheat heat exchanger to be reheated to a desired temperature. Although these multi-circuit systems have been known to incorporate a reheat coil into one or more of the circuits, these circuits and their reheat functions have always been independent or functionally separated (discrete) and they have not had any interaction or communication with each other. Moreover, reheat concepts for each circuit were always identical within the system in the principal of their design and operation.

SUMMARY OF THE INVENTION

In one of the disclosed embodiments of this invention, a multi-circuit refrigerant system incorporates at least two circuits and at least one of those circuits having a reheat coil in the reheat branch of the circuit. The circuits are interrelated in some manner or, in other words, have some means of communication to provide interaction between the circuits. In one embodiment, a flow control valve(s) is installed on the inter-connecting line(s) providing communication between the circuits, such that the amount of refrigerant contained in each circuit can be controlled depending on the environmental conditions, unit operating parameters, external sensible and latent load demands, and a mode of operation for each circuit. In another embodiment, a single heat exchanger is utilized for multiple reheat coils so that the properly configured circuits are communicating through the heat transfer interaction to each other and to the air stream supplied to the conditioned space. In yet another embodiment, a control and a corresponding system design are provided to allow some of the circuits to function in other operational regimes, different from commonly known conventional cooling and conventional dehumidification modes of operation. In one of the described configurations, a bypass line around the condenser is provided to allow such system operational flexibility. In yet another embodiment, the multi-circuit system control unit limits system operation in such a way that it never operates some of the circuits in the conventional cooling mode and some of the circuits in the conventional reheat mode, allowing for enhanced system efficiency and improved component reliability.

It has to be noted that this invention is not referenced to any particular reheat concept but rather provides advantages for any system designed for dehumidification and/or cooling through interaction between the circuits and enhanced control logic.

These and other features of the present invention can be best understood from the following specification and drawings, the following of which is a brief description.

DETAILED DESCRIPTION OF THE PREFERRED EMBODIMENT

Figure 1:
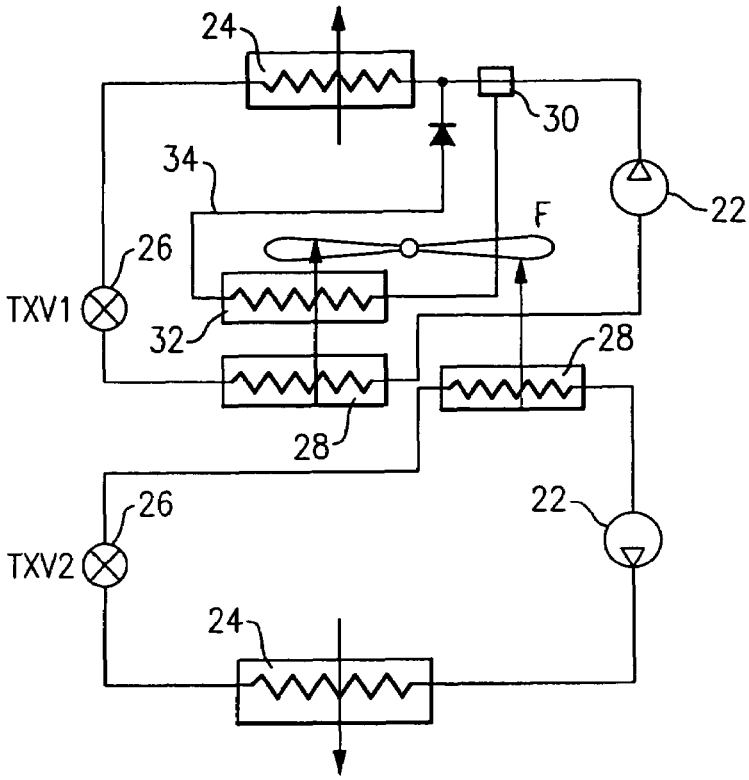
FIG.1 Prior Art
FIG. 1 shows a prior art refrigerant system.

A prior art refrigerant system 20 is illustrated in FIG. 1 as a two-circuit system, with two discrete circuits that do not communicate with each other. Each of two circuits includes a compressor 22, a condenser 24, a main expansion device 26, and an evaporator 28. As known, indoor air to be conditioned passes over the evaporator 28 to be cooled and typically dehumidified when the refrigerant system 20 is in operation. One of the circuits is provided with a reheat coil 32. A selectively operable three-way valve 30 is opened to pass at least a portion of refrigerant through the reheat coil 32 when humidity of the conditioned space is still higher than desired, but temperature of that space falls below the comfort level, requiring the reheat function to be activated. Although only one of many known reheat schematics is shown for illustration purposes, a person ordinarily skilled in the art can envision other reheat concepts implemented as well. In the schematic shown on FIG. 1, the refrigerant is returned through a line 34 downstream of the reheat coil 32 to a junction point upstream of the condenser 24. As is known, at least a portion of air passing over the evaporator 28 also passes over the reheat coil 32 to be reheated to a desired temperature after being passed over the evaporator where it has been cooled and dehumidified. An air moving device F, placed either in front of or behind the evaporator 28 and reheat coil 32 is shown to supply the airflow to the conditioned space. In this manner, temperature of the air passing over the evaporator 28 is lowered to a level typically allowing sufficient moisture removal from the air stream. By then passing at least a portion of this air over the reheat coil 32, the temperature of the air supplied to the conditioned space is increased and approaches the desired temperature set for the environment. While only a single circuit of the two circuits shown in FIG. 1 has the reheat coil 32, it is also known for multi-circuit refrigerant systems to incorporate reheat coils in two or more of the discrete circuits. Obviously, an overall number of discrete circuits in the multi-circuit system may vary with the design and application requirements.

The present invention is directed to providing improved control over the reheat function leading to dehumidification improvement, system efficiency enhancement and component reliability boost.

Figure 2:
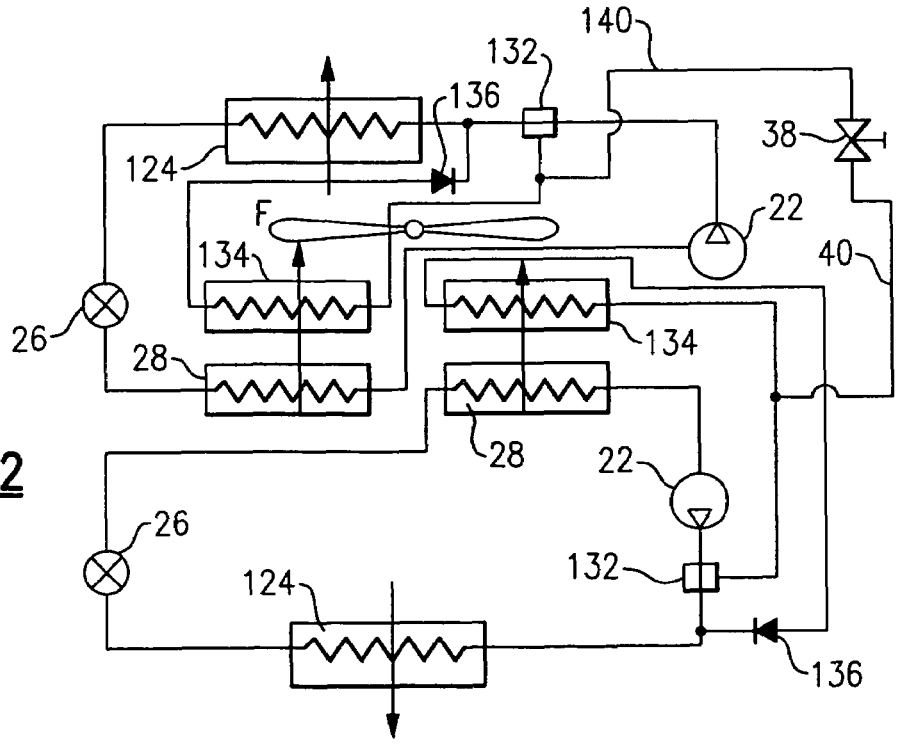
FIG. 2 shows a first embodiment of the present invention.

As shown in FIG. 2, in a refrigerant system 130, the basic components shown in FIG. 1 are also present. In this two-circuit design configuration, both circuits are provided with three-way reheat valves 132, and reheat coils 134. Both circuits are also provided with check valves 136, incorporated in the system design to prevent backflow of the refrigerant to the reheat coil, on the line returning the refrigerant to the point upstream of the condenser 124. The present invention is distinct from the prior art in also providing a flow control device, such as a controllable solenoid valve 38, allowing management of the refrigerant flow through lines 40 communicating the two circuits as well as the refrigerant charge control in both circuits. Although the locations of the communication ports are shown downstream of the valves 132 and upstream of the reheat coils 134, these connection points may vary within each circuit. While valve 38 is opened, refrigerant charge contained in each circuit is redistributed between the circuits. The amount of refrigerant transferred from one circuit to the other depends on the driving pressure differential, restriction size and the amount of time the valve is in the open state. This charge redistribution varies with the operational regime and environmental conditions and affects the amount of refrigerant circulating through the main branch of each circuit as well as through each of the reheat coils.

As known, refrigerant in the circuit naturally migrates to the coldest spot in that circuit. Such charge migration may present problems with system performance and component malfunctioning. Some of the reheat schemes are more subject to charge migration problems than the other. Former reheat circuit designs usually have additional means, such as a bleed line or hot gas bypass, incorporated into the circuit to reduce the charge migration.

Communicating lines 40 and flow control device 38 manage refrigerant transfer between the circuits in response to the changing modes of operation and environmental conditions. As an example, if one of the two circuits is operating in a cooling mode and the other in a reheat mode, over time the refrigerant will migrate to the reheat coil in the first circuit (since no insulation means are perfect) and out of the reheat coil in the second circuit. This may cause undercharge conditions in the first circuit and overcharge conditions in the second circuit. To remedy the situation and to re-optimize the refrigerant charge, valve 38 is opened for a determined period of time to transfer some of the refrigerant from the second circuit to the first circuit. During this transfer, essential system parameters, such as discharge pressures, have to be monitored to determine the amount of time for valve 38 to be open. Also, it has to be assured that the connection point in the second circuit is at a higher pressure than in the first circuit. It can be achieved by a number of means, including (but not limited to) execution of the head pressure control, temporary shutdown of the first circuit, or having connection points at high and low pressure sides of the system for the second and first circuits, respectively. A person ordinarily skilled in the art will recognize a number of conditions at which the system 130 benefits from opening valve 38 and transferring refrigerant from one circuit to the other.

As before, an overall number of circuits as well as a number of circuits incorporating reheat coils in the multi-circuit system can be extended to more than two. Additionally, the number of connection points and their location for each circuit may vary with the system design configuration and application requirements. Once again, various reheat concepts can be utilized and benefit from this invention. Also, each three-way valve can be substituted with a pair of conventional valves, if desired. Various other benefits of operating the valve 38 would be apparent to a worker ordinarily skilled in the art.

Figure 3:
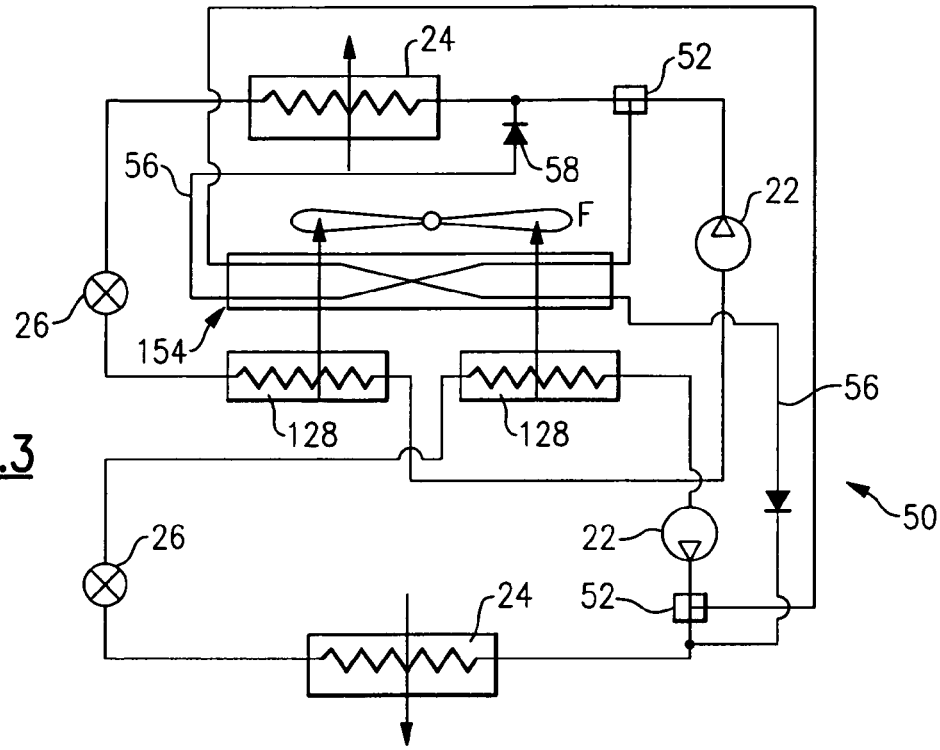
FIG. 3 shows another embodiment of the present invention.

FIG. 3 shows yet another embodiment 50, wherein the three-way valves 52 selectively communicating refrigerant to the reheat branch of each circuit, pass both refrigerant flows through a single reheat coil 54, and then downstream through separate return lines 56, check valves 58, to points upstream of their individual evaporators 128. The use of a single reheat heat exchanger indirectly communicating several circuits (preferably interlaced) provides a reduction in cost, and also additional control over the reheat function. Furthermore, system reliability is enhanced through the reduction of the refrigerant charge migration. For example, if one of the circuits is in a cooling mode of operation and the other one is in a dehumidification mode, the refrigerant will migrate into the reheat coil in the first circuit and out of reheat coil in the second circuit. Since the two circuits are communicating through the heat transfer interaction predominately by conduction, the heat will be transferred from the second reheat coil to the first one, forcing some refrigerant out of the coil and reducing detrimental effects of charge migration. Many other similar circumstances can be foreseen by a person ordinarily skilled in the art. A number of the reheat circuits passing through a single heat exchanger can be extended to more than two. Also, their relative position within this heat exchanger may vary with a particular system design and amount of desired interaction.

Figure 4:
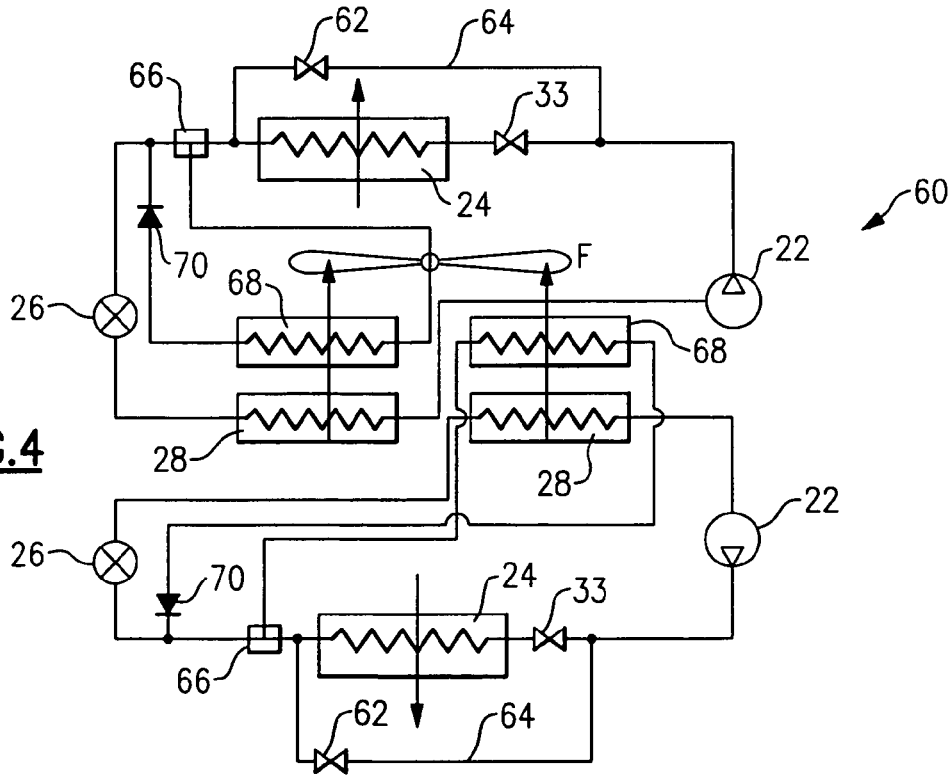
FIG. 4 shows another embodiment of the present invention.

FIG. 4 shows one of the options for yet another embodiment 60 for a multi-circuit refrigerant system with two circuits each having a reheat function. Once again, an overall number of circuits and a number of circuits with a particular reheat function are somewhat independent from each other and can be extended to more than two circuits. This embodiment improves system dehumidification capability through the control logic strategy, so that the system never operates in such a way that some of the circuits are in a conventional cooling and some of the circuits are in a conventional reheat mode. As mentioned above, this embodiment is also independent from any particular reheat concept and can be applied to any known schematic available on the market. As shown, the three-way reheat valves 66 are positioned downstream of the condensers 24 and pass the refrigerant through the reheat coils 68, check valves 70, and to a junction point downstream of the valves 66, but upstream of the main expansion devices 26. As also shown, lines 64 with controllable valves 62 allow for a portion or the entire refrigerant flow to bypass the condensers 24 to provide much better control and higher flexibility in management of the conditioned space humidity and temperature. If the control has been communicated to increase temperature in the conditioned space, some of the refrigerant, or the entire refrigerant flow, bypasses the condenser 24. In this way, the refrigerant reaching the reheat coil 68 provides greater reheat capacity to the air supplied to the conditioned space, so the air temperature can be raised to a desired level. Conversely, if one desires to reduce the supply air temperature, then more (or all) of the refrigerant passes through the condenser 24 in turn diminishing the reheat coil capability. The control can be programmed by a worker of ordinary skill in the art to operate in the proper manner to achieve the desired flow through the reheat coil 68. If the bypass valve 62 is completely closed, the entire flow passes through the condenser 24 and the system operates in an enhanced reheat mode, which is especially desired for hot and humid environments. If more cooling is needed, then some of the circuits are switched or brought on-line in this mode of operation allowing for sufficient sensible cooling and much greater dehumidification. As a result, system performance (and its reaction time to cooling and dehumidification demands) and component reliability (due to charge migration prevention) are improved and the complexity in the control logic is reduced. Conversely, if the valve 33 is closed, the full refrigerant flow is directed through the bypass line 64 and the system operates in one of the conventional reheat modes for applications where dehumidification and no (or very little) cooling or heating is needed. When only dehumidification is required, then some or all of the circuits operate in such conventional reheat modes.

Thus, if the system operates in the conventional reheat mode to mainly satisfy the demands for dehumidification, and the call for cooling is issued, then the system switches one of the circuits into the enhanced reheat mode to satisfy cooling requirements and simultaneously boosts its dehumidification capability. If more cooling is needed, then another circuit is switched to the enhanced reheat mode of operation. This strategy will continue until all the circuits capable of the enhanced reheat mode are operating in this mode. If still more cooling is required, the circuits are switched to the conventional cooling mode. It becomes obvious to a person ordinarily skilled in the art that executing such a strategy, and never operating some of the circuits in the conventional cooling and some of the circuits in the reheat mode simultaneously, will greatly benefit system performance and reliability as well as improve its reaction time in satisfying the conditioned space demands in terms of needed temperature and humidity. When no cooling is needed, the process is reversed.

Referring back to FIG. 2, it becomes obvious to a person ordinarily skilled in the art, that the identical control strategy can be applied to this relatively simple reheat concept. Once again, the switching will occur not only between conventional cooling and conventional reheat modes of operation but for all the circuits simultaneously to more quickly satisfy the conditioned space requirements. The control strategy for other reheat schematics is executed in a similar manner.

Although preferred embodiments of this invention have been disclosed, a worker of ordinary skill in this art would recognize that certain modifications would come within the scope of this invention. For that reason, the following claims should be studied to determine the true scope and content of this invention.

What is claimed is:

1. A refrigerant system comprising:

a plurality of circuits, with each of said circuits including a compressor, a condenser downstream of said compressor, a main expansion device downstream of said condenser, and an evaporator downstream of said main expansion device;

at least one of said circuits having a reheat loop;

said reheat loop receiving refrigerant, and passing the refrigerant through a reheat coil, the refrigerant returning to the circuit downstream of the reheat coil, and an air-moving device for passing air over said evaporator, and over said reheat coil; and flow through said reheat coil being controlled between said plurality of circuits.

2. The refrigerant system as set forth in claim 1, wherein flow control devices connect supply lines communicating refrigerant to said circuits, said flow control devices being opened to control the flow of refrigerant between said circuits.

3. The refrigerant system as set forth in claim 2, wherein said flow control device is a valve.

4. The refrigerant system as set forth in claim 3, wherein at least two of said circuits have a reheat loop.

5. The refrigerant system as set forth in claim 1, wherein a reheat coil is provided for at least two of said circuits, and a common heat exchanger is utilized receiving refrigerant flow from each of said circuits and actively communicating through heat transfer interaction.

6. The refrigerant system as set forth in claim 1, wherein a control unit operates said circuits such that at least one circuit is in a reheat mode or shut off and the remaining circuits are shut off, or in an enhanced reheat mode.

7. The refrigerant system as set forth in claim 1, wherein a control unit operates said circuits in such a way that all circuits are either in a conventional reheat mode, or shut off, or in a conventional cooling mode or shut off.

8. The refrigerant system as set forth in claim 1, wherein a control unit operates said circuits in such a way that all circuits are either in an enhanced reheat mode or shut off or in a conventional cooling mode or shut off.

9. A refrigerant system comprising:

a plurality of circuits, with each of said circuits including a compressor, a condenser downstream of said compressor, a main expansion device downstream of said condenser, an evaporator downstream of said main expansion device;

at least one circuit having a reheat loop;

said reheat loop receiving refrigerant, and passing the refrigerant through a reheat coil, the refrigerant returning to the circuit downstream of the reheat coil, and an air-moving device for passing air over said evaporator, and over said reheat coil; and flow control devices connecting supply lines communicating said refrigerant to said reheat coil, said flow control devices being opened to control the flow of refrigerant between said plurality of circuits.

10. The refrigerant system as set forth in claim 9, wherein said flow control device is a valve.

11. The refrigerant system as set forth in claim 9, wherein at least two of said circuits have reheat loops.

* * * * *